US009091016B2

(12) United States Patent
Lam et al.

(10) Patent No.: US 9,091,016 B2
(45) Date of Patent: Jul. 28, 2015

(54) GARMENT STEAMER

(75) Inventors: Peggy Lam, Randolph, MA (US); Eric Wall, Auburn, AL (US); Kim Chun Chiu, Kowloon (CN)

(73) Assignee: Euro-Pro Operating LLC, Newton, MA (US)

( * ) Notice: Subject to any disclaimer, the term of this patent is extended or adjusted under 35 U.S.C. 154(b) by 105 days.

(21) Appl. No.: 13/261,632

(22) PCT Filed: Oct. 18, 2011

(86) PCT No.: PCT/US2011/056642

§ 371 (c)(1),
(2), (4) Date: Apr. 10, 2013

(87) PCT Pub. No.: WO2012/054433

PCT Pub. Date: Apr. 26, 2012

(65) Prior Publication Data

US 2013/0276485 A1 Oct. 24, 2013

Related U.S. Application Data

(60) Provisional application No. 61/394,846, filed on Oct. 20, 2010.

(51) Int. Cl.

| | |
|---|---|
| ***D06F 87/00*** | (2006.01) |
| ***D06F 73/00*** | (2006.01) |
| ***D06F 75/12*** | (2006.01) |
| ***D06F 57/02*** | (2006.01) |

(52) U.S. Cl.

CPC ..... *D06F 87/00* (2013.01); *D06F 73/00* (2013.01); *D06F 57/02* (2013.01); *D06F 75/12* (2013.01)

(58) Field of Classification Search

CPC ..... D06F 75/10; A47L 11/4086; A47L 7/00; B08B 2230/01; B08B 2230/00

USPC ..... 68/222; 15/320, 321, 354; 137/577, 137/592; 210/540

See application file for complete search history.

(56) References Cited

U.S. PATENT DOCUMENTS

| | | | | |
|---|---|---|---|---|
| 2,081,798 | A * | 5/1937 | Dinneen | 222/153.13 |
| 2,387,757 | A * | 10/1945 | Hoecker | 38/77.5 |
| 3,969,607 | A * | 7/1976 | Osrow et al. | 392/335 |
| 4,366,367 | A * | 12/1982 | Mazzucco | 392/335 |
| 8,087,529 | B2 * | 1/2012 | Koerber | 220/203.22 |
| 2005/0150261 | A1 | 7/2005 | Carlucci | |
| 2007/0064355 | A1 * | 3/2007 | Vialle et al. | 361/1 |
| 2009/0255302 | A1 | 10/2009 | Haan | |
| 2010/0037494 | A1 | 2/2010 | Krebs et al. | |
| 2010/0282333 | A1 * | 11/2010 | Newman et al. | 137/115.13 |

FOREIGN PATENT DOCUMENTS

KR 20-0434617 Y1 12/2006

* cited by examiner

*Primary Examiner* — Michael Barr
*Assistant Examiner* — Rita Adhlakha
(74) *Attorney, Agent, or Firm* — Yang IPCo, PLLC

(57) ABSTRACT

A garment steamer has a housing with a reservoir and a boiler for converting water to steam. The housing includes a normally closed valve in a flow path between the reservoir and the boiler. A removable fill plug in a fill opening or inlet of the reservoir is configured to engage the valve to permit water to be communicated from the reservoir via an outlet to the boiler for conversion into steam. The plug-actuated valve isolates the boiler from the reservoir when the plug is removed, providing safer refilling when the boiler is hot. The garment steamer also includes a steam discharge head coupled by a hose to the housing and configured to direct steam onto a garment or similar item.

4 Claims, 12 Drawing Sheets

GARMENT STEAMER

BACKGROUND

The present invention is related to the field of garment steamers that apply steam to remove wrinkles from clothing and similar fabric items.

Garment steamers are generally constructed to include a user-fillable reservoir for water, a heating element for generating steam from water in the reservoir, and an external surface from which the steam escapes to be directed to a garment or similar item being worked on. Some garment steamers may be sufficiently compact to be used in an entirely handheld fashion, while others may employ a larger, relatively stationary reservoir connected by a hose to a handheld steaming head that is maneuvered by a user during operation.

SUMMARY

There are a variety of aspects of garment steamers that affect their usability. The reservoir, for example, is preferably easy to refill and relatively large in order to reduce the frequency of refilling. The garment steamer preferably heats up quickly so as to be ready for use soon after it has been turned on. Portability is often desired, as the garment steamer may be used in multiple places or moved between a storage location and a location of use. The garment steamer should also be safe to use.

A garment steamer is disclosed that includes features for enhanced usability, especially with respect to safe and effective filling of the reservoir and heating of the water to generate steam. Other features are directed to portability and user handling of the garment steamer.

In one embodiment, a disclosed garment steamer includes a base and a housing configured to be removably attached to the base. For example, the housing may be detached from the base and carried by the user. In one embodiment, the housing for a garment steamer system may include a first portion having an inlet for receiving water and a second portion having an outlet for discharging water, the second portion being in communication with the first portion. In some instances, the first portion of the housing can be the top side or the side wall of the housing. In other instances, the second portion can be situated underneath or below the first portion. In general, each of the first portion and the second portion can be integrally formed as a single unit into a water tank or reservoir. The housing includes a first device, such as a fill plug, in communication with the inlet for substantially sealing water within the first portion. The first device is capable of extending into the first portion of the housing. The housing also includes a second device, such as a valve assembly, in communication with the outlet for substantially sealing water within the second portion. The second device can be actuated by the first device such that in an engaged configuration, water may exit from the outlet to a separate boiler where the water is heated into steam.

By use of the above configuration, water being heated is generally separated from the generally larger amount of water in the water tank, promoting faster heating. When the first device is removed to permit filling of the water tank, the second device is de-actuated. In the event that the boiler is still hot, this de-actuation of the second device prevents heated water and steam from escaping via the inlet and potentially scalding the user. Thus user safety is enhanced.

In one embodiment, the garment steamer system may include a support structure such as a pole for supporting a user-held head or handle from which steam exits during use.

The garment steamer system may include a conduit such as a hose between the handle and the heating apparatus to facilitate transfer of steam from the base to the handle. In another embodiment, the base of the garment steamer system may include a plurality of wheels to facilitate mobility of the garment steamer. In some embodiments, the housing and the base may be integrally formed such that the first portion and the second portion of the housing, as well as the base, may be produced as a single unit using a plastic injection molding process.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Figure 1:
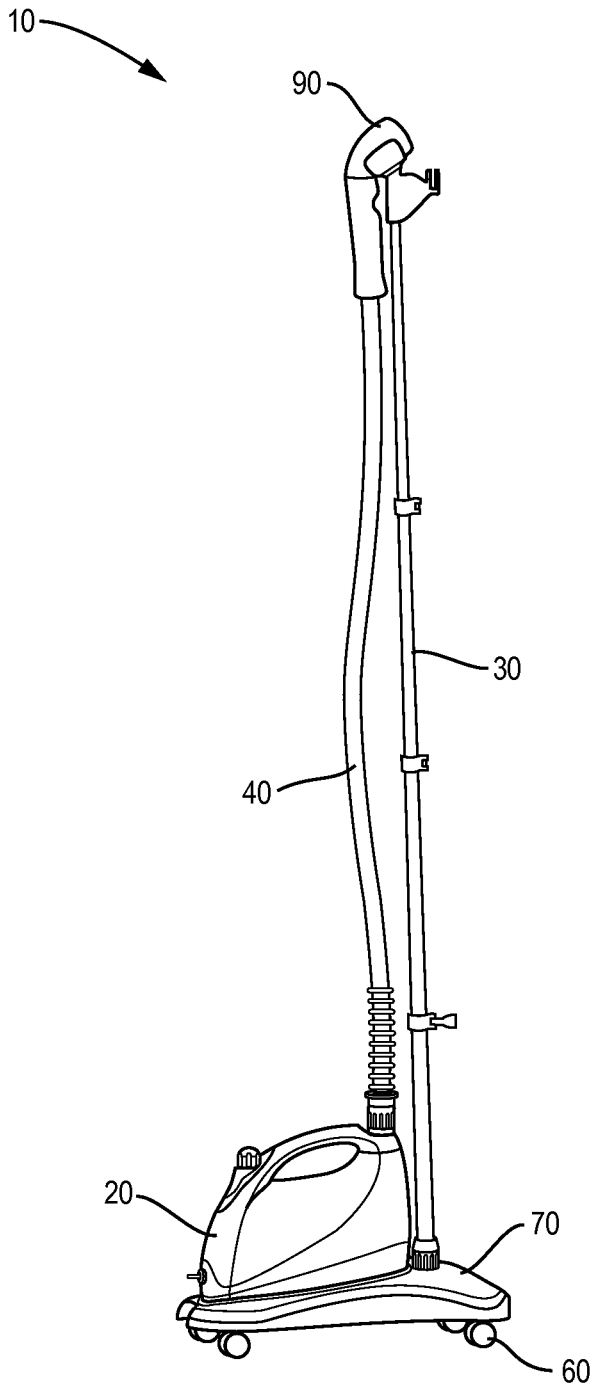
FIG. 1 is an illustration of a garment steamer according to one embodiment of the present disclosure.

FIG. 1 is an illustration of a garment steamer 10 according to one embodiment of the present disclosure. The garment steamer 10 includes a base 70 configured to support a housing 20, where the housing 20 is capable of housing a water tank and a heating apparatus such as a boiler for converting water into steam, among other electrical components and circuitry. In one embodiment, the housing 20 and the base 70 may be integrally formed as a single unit or single component. In other words, the housing 20 and the base 70 may be concurrently manufactured via a plastic injection molding process.

The bottom of the base 70 may include a plurality of wheels 60 to facilitate transportation of the garment steamer 10 from place to place as necessary. In some instances, a support structure 30 such as a telescopic pole may be coupled to the top of the base 70, the support structure 30 being substantially adjacent to the housing 20. The support structure 30 may support the likes of a handle or "head" 90, which may be in fluid communication with the housing 20 via a conduit 40 such as a hose for delivering steam onto a garment or similar item (not shown). In some embodiments, the support structure 30 may also include a hook for holding a piece of clothing or garment. In other embodiments, the handle 90 may include an on/off switch or a trigger (not shown) for discharging steam.

Figure 2:
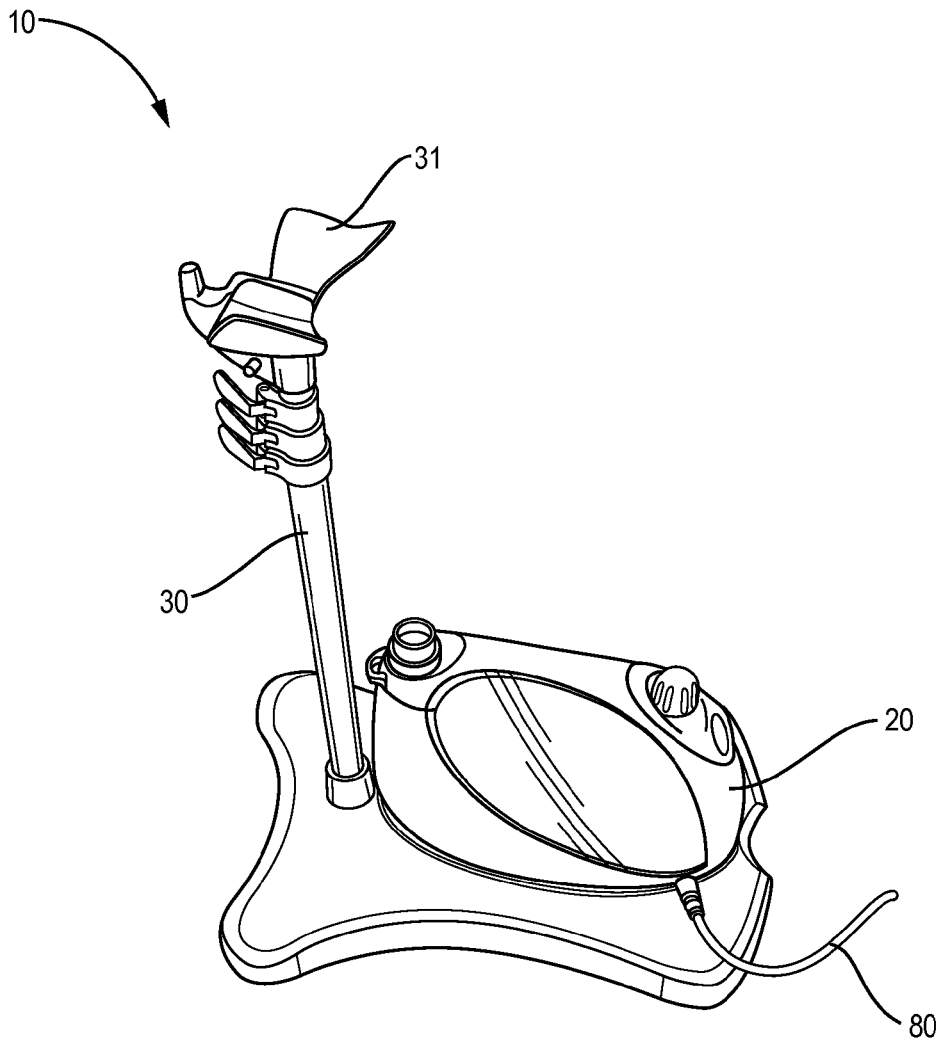
FIG. 2 is a perspective view of a garment steamer according to one embodiment of the present disclosure.

FIG. 2 is a perspective view of a garment steamer 10 according to one embodiment of the present disclosure, where the support structure 30 of the garment steamer 10 is in a retracted position. As shown, the top of the support structure 30 may include a holder 31 for supporting the handle 90 (FIG. 1). In some instances, a side wall of the housing 20 may include an electrical cord 80 which may be plugged into a wall outlet for powering electrical assemblies and components within the housing 20.

Figure 3:
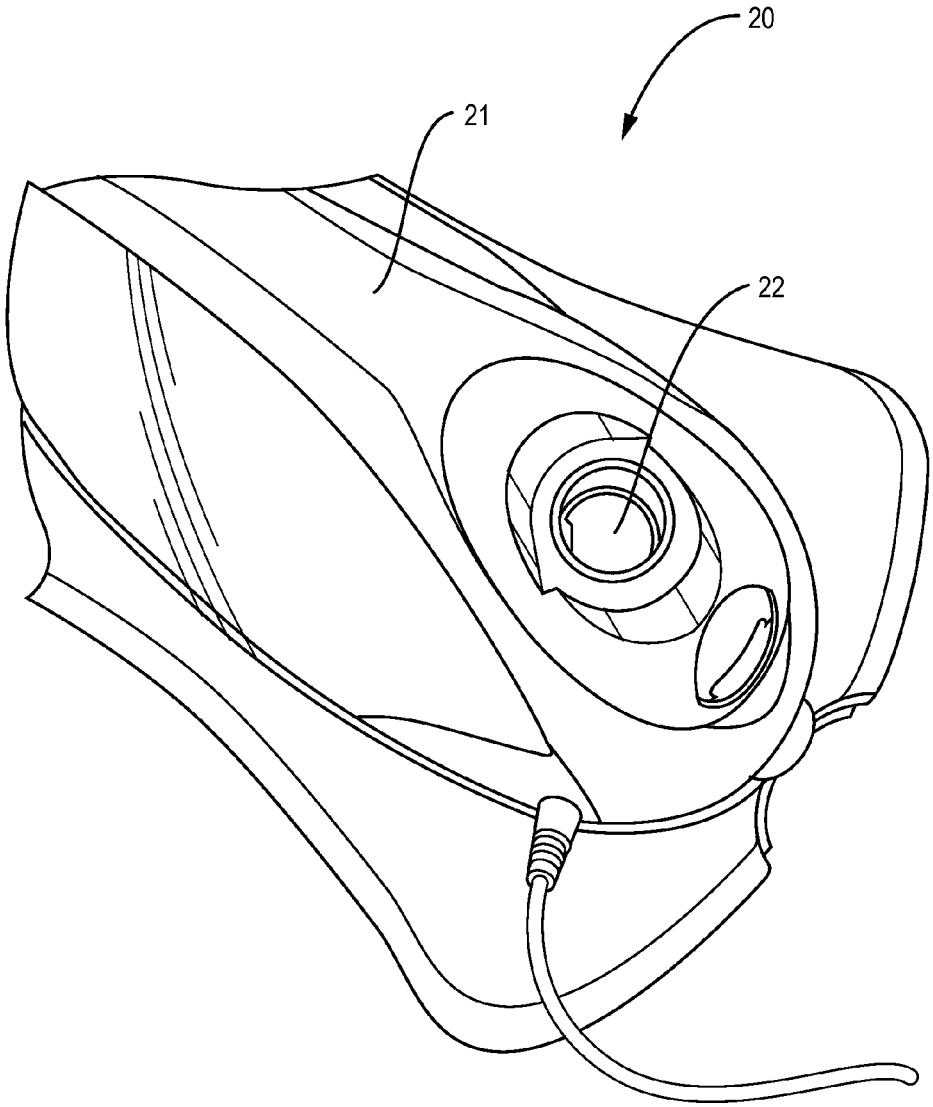
FIG. 3 is a top-down view of a housing of the garment steamer of FIG. 2.

FIG. 3 is a top-down view of the housing 20 of the garment steamer 10 of FIG. 2. In some embodiments, the upper section of the housing 20 may include a handle 21 to facilitate removal of the housing 20 from the base 70. In other embodiments, the handle 21 may facilitate transportation of the housing 20 when the housing 20 is detachably removed from the base 70. In some instances, the housing 20 may also include a strap (not shown) for carrying the housing 20 on a user's shoulder. In one embodiment, the top of the housing 20 includes an inlet 22 for filling a reservoir within the housing 10 with water.

Figure 4:
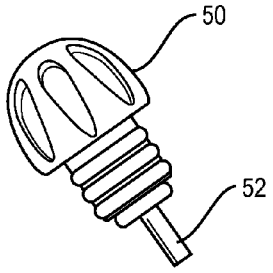
FIG. 4 is a side-view of a plug for the housing of the garment steamer of FIG. 2.

FIG. 4 is a side-view of a cover or plug 50 for the housing of the garment steamer 10 of FIG. 2. In one embodiment, the cover or plug 50 may be a device that can be removably coupled to the inlet 22 of the housing 20 to ensure that water does not spill when it is received in the housing 20. In one example, the plug 50 may be secured to the inlet 22 by a twisting action (e.g., clockwise or counterclockwise). In another example, the plug 50 may secure the inlet 22 by a push-pull action using flexible valve baffles. In other instances, the plug 50 may be substantially secured to the inlet 22 via other suitable securing mechanism including a combination of twisting and pushing action, among others. In one embodiment, the bottom portion of the plug 50 may include an extension 52 that may extend substantially into the housing 20 when the plug 50 is coupled to the inlet 22. The extension 52 may be used to trigger a complementary assembly within the housing 20 which will become more apparent in subsequent figures and discussion.

Figure 5:
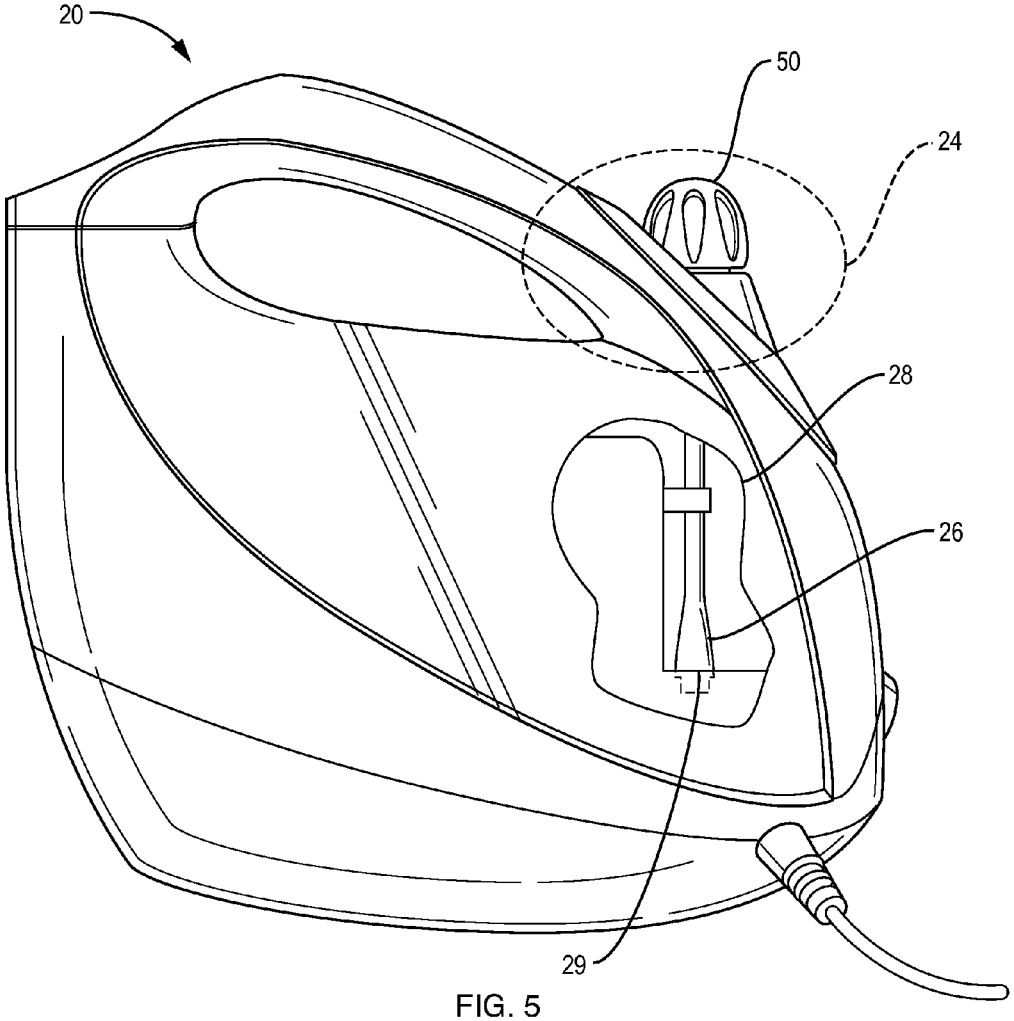
FIG. 5 is a side-view of a portion of the housing of the garment steamer of FIG. 2 without the plug of FIG. 4.

FIG. 5 is a side-view of a portion of the housing 20 of the garment steamer 10 of FIG. 2. In one embodiment, the housing 20 includes a first section 24 and a second section 28. In some instances, each of the first section 24 and the second section 28 may form a portion of a water tank for storing water in the housing 20. In other instances, the first section 24 and the second section 28 may collectively form a water tank within the housing 20. In some embodiments, the first section 24 and the second section 28 may be integrally formed as a single unit.

In one embodiment, the first section 24 includes an inlet 22 for receiving water in the first section 24. The inlet 22 may be sealed by a plug 50 or other suitable securing devices. In some embodiments, the first section 24 may include the top side of the housing 20. In other embodiments, the first section 24 may include a side wall of the housing 20. In one embodiment, the second section 28 includes an outlet 29 where water can exit from the second section 28. In one embodiment, the second section 28 may include an actuable assembly 26. The actuable assembly 26 may be a valve assembly 26 capable of being actuated by the plug 50. For example, the valve assembly 26 may engage the extension 52 of the plug 50. In one embodiment, in a disengaged position (e.g., plug 50 unsecured or removed), the valve assembly 26 is not being actuated by the extension 52. Accordingly, the valve assembly 26 is able to substantially secure the outlet 29 and prevent water from leaving. It will be appreciated that this can be accomplished using a spring or similar element to bias the valve assembly 26 in a closed position, where the bias is overcome upon actuation by the extension 52 of the plug 50 moving the valve assembly 26 into an open position. In other instances, the valve assembly 26 can be coupled to the outlet 29 in a substantially similar manner as that of the plug 50 and the inlet 22 for performing substantially similar functions.

FIG. 5 shows the garment steamer 10 including the plug 50 installed or located in the inlet 22. In this configuration with the plug 50 coupled to the inlet 22, the plug 50 can substantially seal water within the first section 24. In addition, the extension 52 of the plug 50 extends substantially into at least a portion of the first section 24 for actuating the valve assembly 26 when the inlet 22 is secured with the plug 50, as explained in more detail below.

Figure 6:
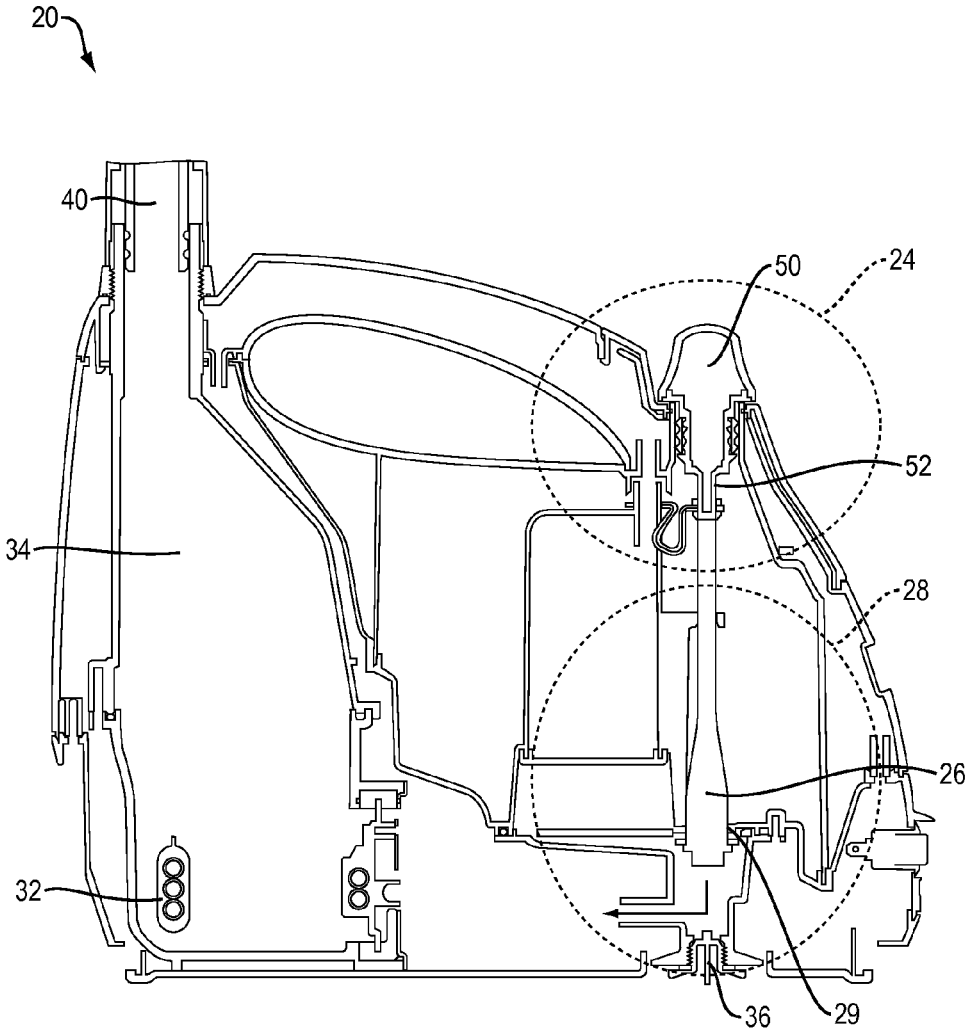
FIG. 6 is a schematic sectional view of the housing of the garment steamer of FIG. 2.

FIG. 6 is a schematic view of the housing 20 of the garment steamer 10 of FIG. 2, the schematic including structure shown in FIG. 5. As shown, the housing 20 also includes a water drain 36, a heating element assembly 32, a boiler assembly 34, and a conduit 40 for sending the steam up into the handle 90 (FIG. 1). In case there is excess water buildup, it may be drained by unplugging the plug in the water drain 36. FIG. 6 shows the plug 50 and valve assembly 26 in the above-discussed configuration in which the extension 52 actuates the valve assembly 26 of the second section 28 such that water can exit the outlet 29. Once water exits the second section 28 as indicated by the arrow, water can be heated by the heating element assembly 32 and the boiler assembly 34. In some embodiments, additional electrical components or circuitry (not shown) may be incorporated as necessary for heating purposes. Once an appropriate temperature has been achieved, water can be converted to steam and transported up the conduit 40 to be discharged from the handle 90 onto a piece of garment.

Some of the advantages of the current system over those of the prior art include the ability to retain water in the housing 20 without substantial leaking to occur, among others. This can occur when the housing 20 is attached to the base 70 or when the housing 20 is used as a mobile unit. In addition, minimal condensation may form within the conduit 40.

Figure 7:
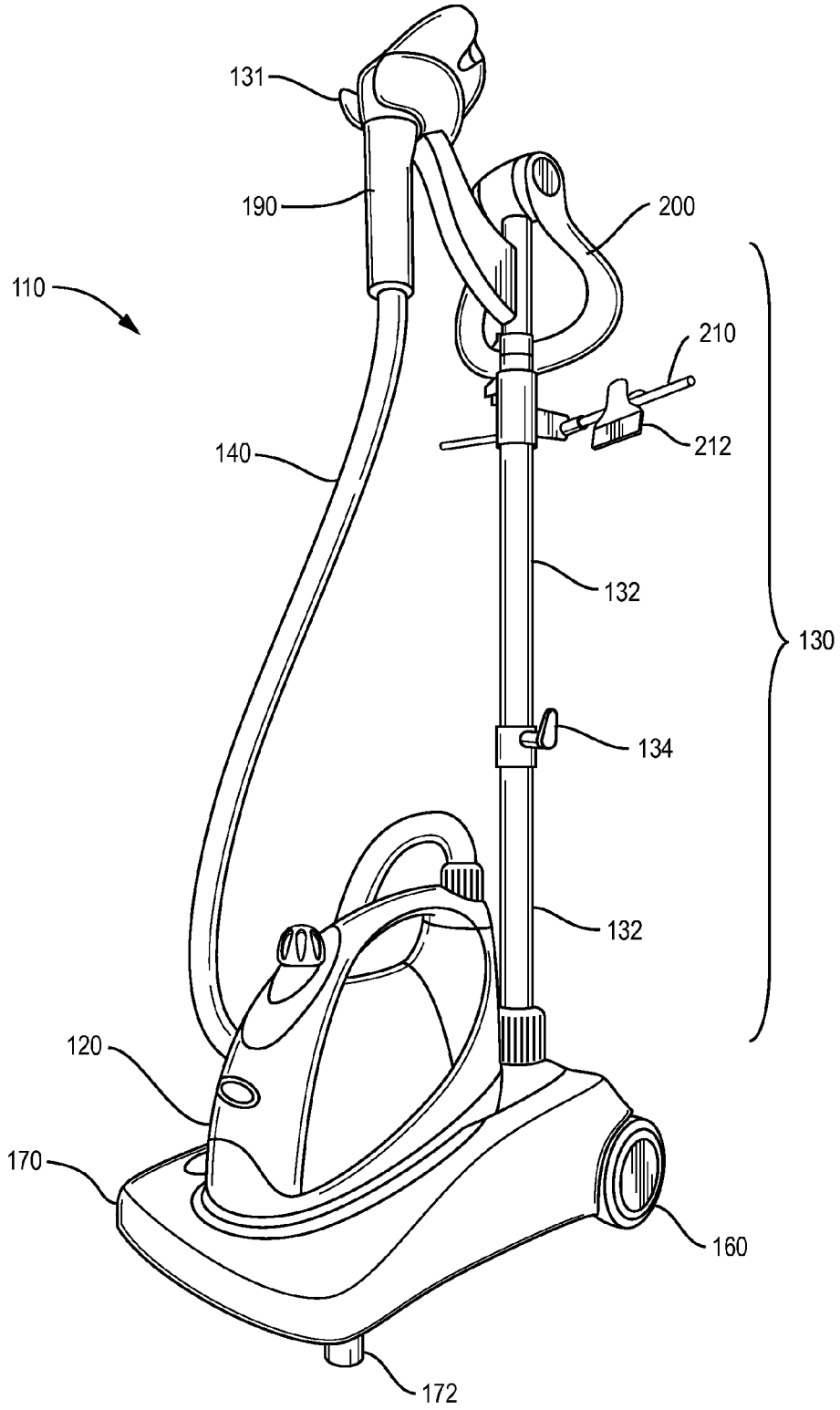
FIG. 7 is a an illustration of a garment steamer according to another embodiment of the present disclosure.

FIG. 7 is an illustration of a garment steamer 110 according to a second embodiment of the present disclosure. The garment steamer 110 includes a base 170 configured to support a housing 120, where the housing 120 is capable of housing a water tank and a heating apparatus such as a boiler for converting water into steam, among other electrical components and circuitry. In one embodiment, the housing 120 and the base 170 may be integrally formed as a single unit or single component. In other words, the housing 120 and the base 170 may be concurrently manufactured via a plastic injection molding process.

The bottom of the base 170 may include supports such as front posts 172 and rear wheels 160, which facilitate transportation of the garment steamer 110 from place to place as necessary. To this end, a foldable handle 200 is used to tilt and steer the garment steamer during such transportation on a floor or similar surface. A support structure 130 such as a telescopic pole may be coupled to the top of the base 170, the support structure 130 being substantially adjacent to the housing 120. The support structure 130 includes a plurality of pole segments 132 and segment locks 134. The support structure 130 may also include a holder 131 for supporting a handle or "head" 190, which is generally in fluid communication with the housing 120 via a conduit 140 such as a hose for delivering steam onto a garment or similar item (not shown). The handle 90 may include an on/off switch or a trigger (not shown) for discharging steam. As shown, the support structure 130 may also support the foldable handle 200, as well as a cross arm 210 with a clip 212 for holding a garment in position as described in more detail below.

Figure 8:
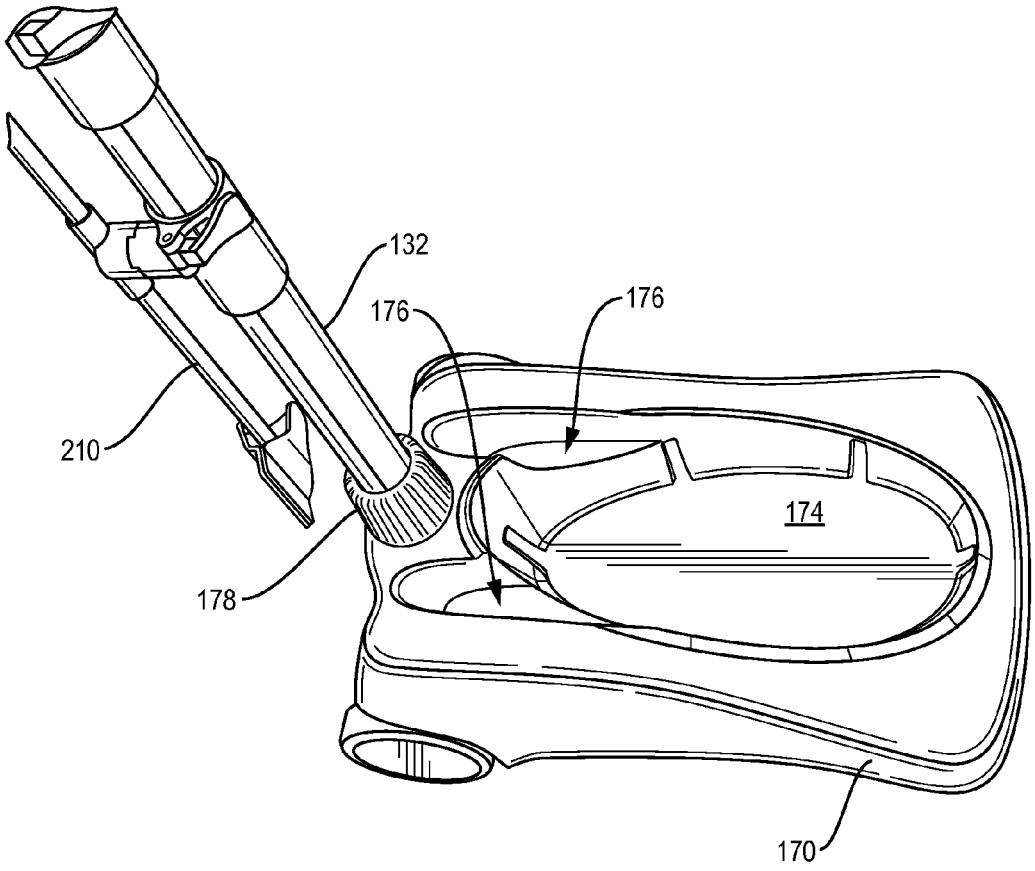
FIG. 8 is a top perspective view of a base for the garment steamer of FIG. 7.

FIG. 8 provides a top view of the base 170, showing a central well 174 for receiving the housing 120. Channels 176 provide clearance for passage of electrical cords extending from the rear of the housing 120 as described below. The support structure 130 is secured to the base 170 by a female threaded collar 178 that holds a flanged end of the lowest pole 132 against a corresponding male threaded post (not visible) extending upwardly from the base 170.

In FIG. 8 the cross arm 210 is shown in a vertical or "unused" position, having been rotated 90 degrees from the horizontal or "in-use" position of FIG. 7. In the unused position there is less possibility of the cross arm 210 undesirably interfering with a user or with other apparatus.

Figure 9:
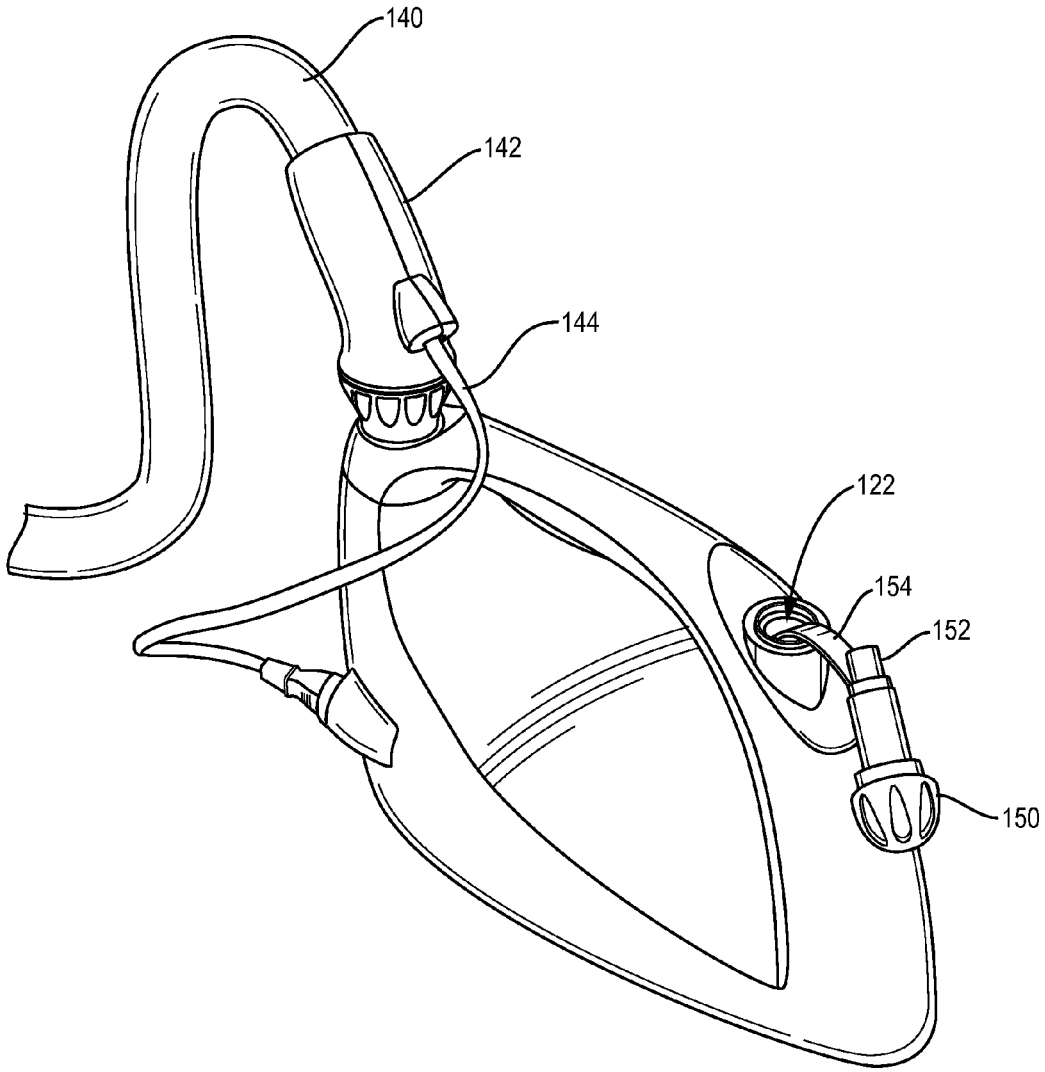
FIG. 9 is a top perspective view of the housing of the garment steamer of FIG. 7.

FIG. 9 shows an upper part of the housing 120 including a plastic sleeve 142 on the lower part of the conduit 140 where it meets the housing 120. An electrical cord 144 passes through a lateral opening of the sleeve 142 and extends along the length of the conduit 140 to the handle 190 (FIG. 7). Within the conduit 140, the electrical cord 144 is disposed between an inner flexible hose member of the conduit 140 (not shown) an a woven outer sheath of the conduit 140 (visible in FIG. 9). The electrical cord 144 provides electrical current to a heating element in the handle 190 as described in more detail below.

Also shown in FIG. 9 is a fill plug 150 used to close a fill opening 122 in the top of the housing 120. The fill plug 150 may mechanically engage the fill opening 122 in any of a variety of ways, including for example by use of a surrounding O ring or similar component establishing a frictional fit, or by screw threads or similar twisting mechanism. The fill plug 150 includes an extension 152 that engages an actuable assembly or valve within the housing 120 in the same manner as discussed above for the plug extension 52 and actuable assembly 26. The fill plug 150 is secured to the housing 120 by an elongated tether 154, preferably made of a flexible and strong plastic material.

Figure 10:
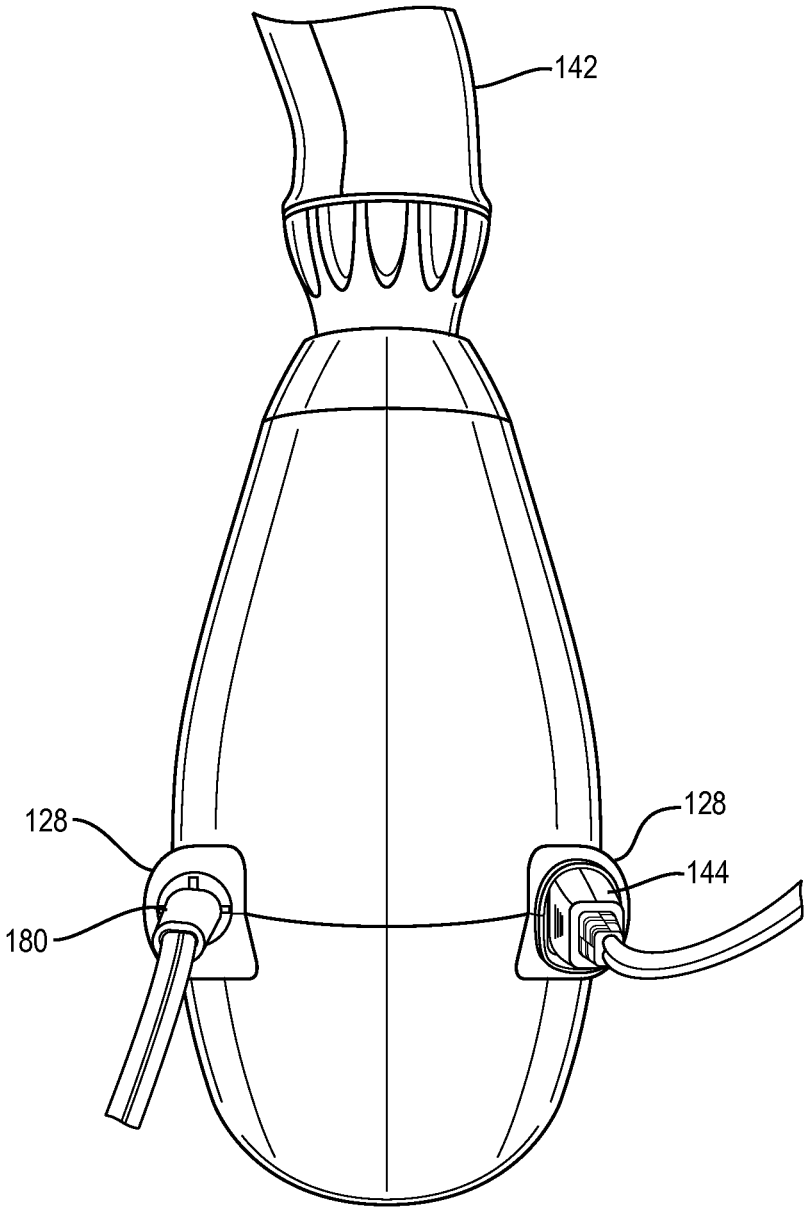
FIG. 10 is a rear view of a housing of the garment steamer of FIG. 7.

FIG. 10 shows the rear of the housing 120. The electrical cords 180 and 144 extend rearward from respective projections 128 of the housing 120. As mentioned above, the end portions of the electrical cords 180, 144 at the housing 120 are received within the channels 176 of the base 170 (FIG. 8) when the housing 120 is seated thereon.

Figure 11:
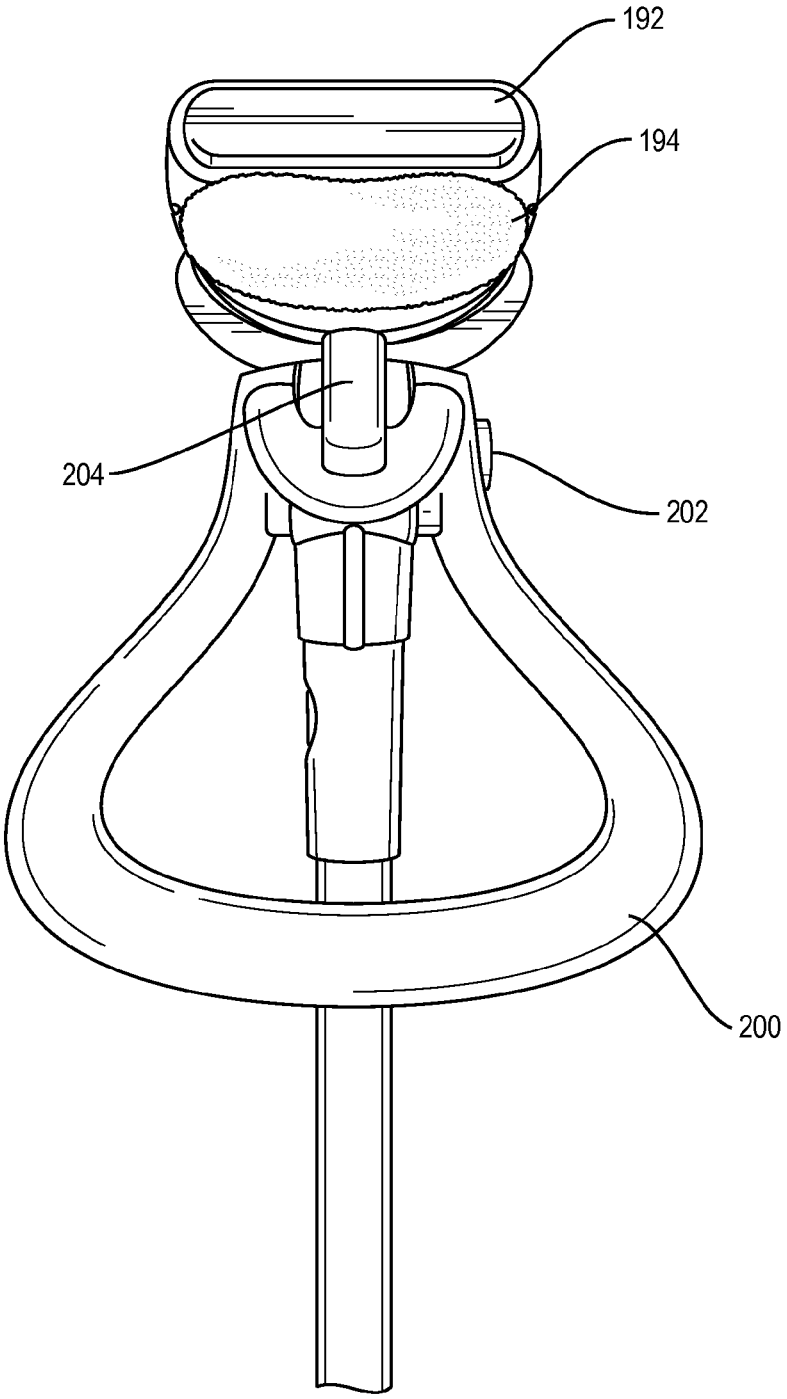
FIG. 11 is a rear view of an upper part of a support structure of the garment steamer of FIG. 7.

FIG. 11 shows the upper part of the support structure 130 and handle 190 in greater detail. The handle 190 includes an electrically heated pressing element 192 and an immediately adjacent steaming area shown covered by a permeable cloth 194. The steaming area of the handle 190 generally includes a plurality of small openings (not visible in FIG. 11) through which steam from the conduit 140 passes in use. The pressing element 192 is heated by internal electrical coils with current from the electrical cord 144 (FIG. 9). In one embodiment, the pressing element 192 has a positive-temperature-coefficient (PTC) characteristic that automatically regulates the operating current and temperature. The pressing element 192 is preferably heated at a rate commensurate with the rate at which steam is generated, so that a situation can be avoided in which steam contacts a relatively cold pressing element 192 forming undesired condensation.

Also shown in FIG. 11 is the foldable handle 200 in a downward or retracted position. A pushbutton 202 is used to release an internal rotary latch to enable the foldable handle 200 to be rotated to an upward or in-use position. Formed integrally with the foldable handle 200 is a hook 204 usable to receive a clothes hanger to support a garment which is to receive steam treatment. In this case the garment will hang downward, and the support structure 130 and cross arm 210 can be adjusted so that the clip 212 (FIG. 8) can hold the bottom part of the garment in place.

Figure 12:
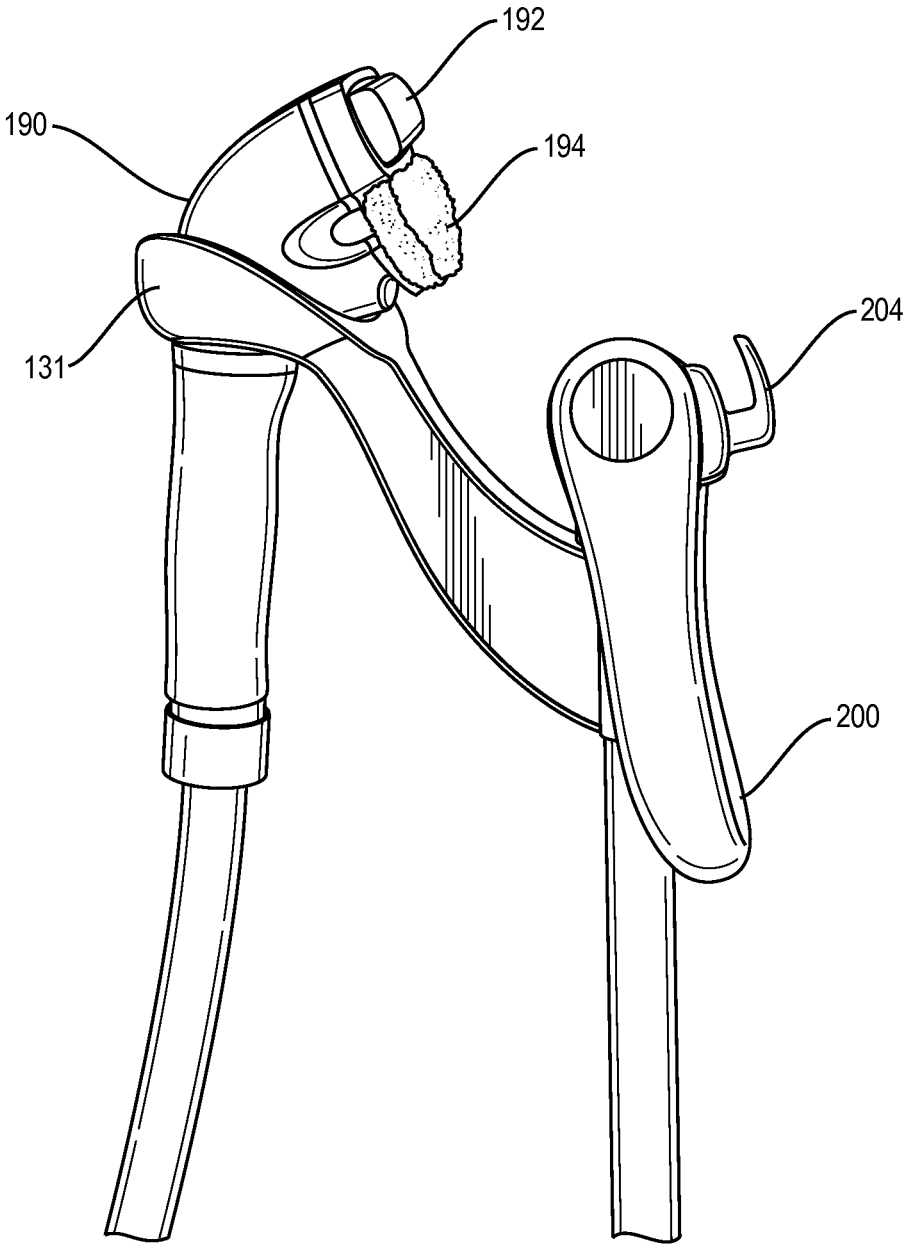
FIG. 12 is a first side view of the upper part of the support structure of the garment steamer of FIG. 7.

FIG. 12 shows a side view of the upper part of the support structure 130 with the foldable handle 200 in the downward position as in FIG. 11.

Figure 13:
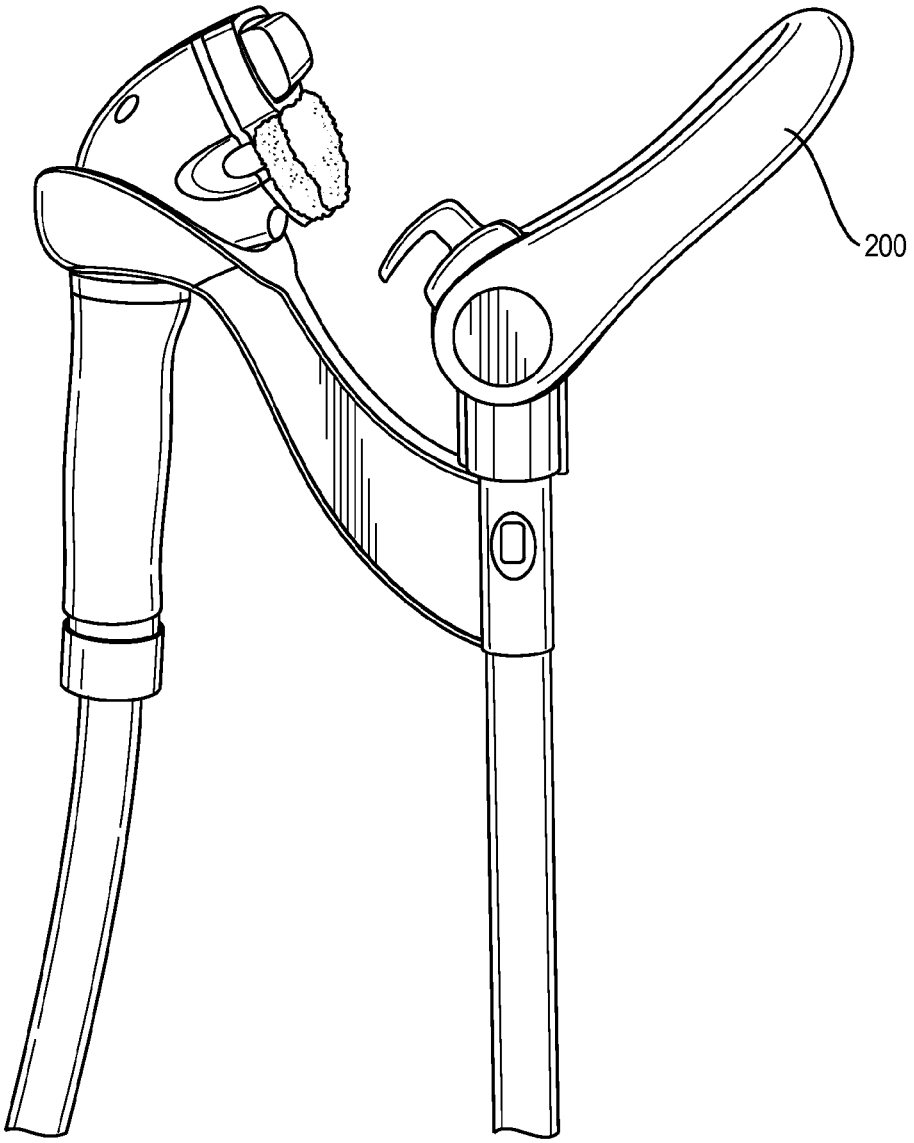
FIG. 13 is a second side view of the upper part of the support structure of the garment steamer of FIG. 7.

FIG. 13 shows a side view of the upper part of the support structure 130 with the foldable handle 200 in an upward position, having been rotated upward from the downward position of FIG. 12. In this position, the foldable handle 200 can be grasped by a user to enable the user to both tilt the garment steamer 110 rearward and push or pull to move the garment steamer 110 on its rear wheels 160.

While various embodiments of the invention have been particularly shown and described, it will be understood by those skilled in the art that various changes in form and details may be made therein without departing from the scope of the invention as defined by the appended claims.

What is claimed is:

1. A housing for a garment steamer, comprising:

(a) a water tank having a first section and a second section, wherein the first section includes an inlet for receiving water and the second section includes an outlet for discharging water, wherein the second section is in communication with and positioned underneath the first section;

(b) a first device disposed within the first section and in communication with the inlet for substantially sealing water within the first section, wherein the first device is capable of extending into at least a portion of the first section of the water tank;

(c) a second device disposed within the second section and in communication with the first device, wherein in an engaged configuration the first device actuates the second device thereby discharging water through the outlet; and wherein the first device is a fill plug and the second device is a valve assembly.

2. A housing for a garment steamer, comprising:

(A) a water tank having a first section and a second section, wherein the first section includes an inlet for receiving water and the second section includes an outlet for discharging water, wherein the second section is in communication with and positioned underneath the first section;

(b) a first device disposed within the first section and in communication with the inlet for substantially sealing water within the first section, wherein the first device is capable of extending into at least a portion of the first section of the water tank;

(c) a second device disposed within the second section and in communication with the first device, wherein in an engaged configuration the first device actuates the second device thereby discharging water through the outlet;

wherein the first device is a fill plug and the second device is a valve assembly; and wherein the valve assembly is biased in a normally closed position and is actuated into an open position by the fill plug.

3. A housing for a garment steamer, comprising:

(a) a water tank having a first section and a second section, wherein the first section includes an inlet for receiving water and the second section includes an outlet for discharging water, wherein the second section is in communication with and positioned underneath the first section;

(b) a first device disposed within the first section and in communication with the inlet for substantially sealing water within the first section, wherein the first device is capable of extending into at least a portion of the first section of the water tank;

(c) a second device disposed within the second section and in communication with the first device, wherein in an engaged configuration the first device actuates the second device thereby discharging water through the outlet;

wherein the first device is a fill plug and the second device is a valve assembly;

wherein the valve assembly is biased in a normally closed position and is actuated into an open position by the fill plug; and wherein the fill plug is a user-removable fill plug that actuates the valve assembly when the fill plug is secured to the inlet.

4. A housing for a garment steamer, comprising:

(a) a water tank having a first section and a second section, wherein the first section includes an inlet for receiving water and the second section includes an outlet for discharging water, wherein the second section is in communication with and positioned underneath the first section;

(b) a first device disposed within the first section and in communication with the inlet for substantially sealing water within the first section, wherein the first device is capable of extending into at least a portion of the first section of the water tank;

(c) a second device disposed within the second section and in communication with the first device, wherein in an engaged configuration the first device actuates the second device thereby discharging water through the outlet;

wherein the first device is a fill plug and the second device is a valve assembly;

wherein the valve assembly is biased in a normally closed position and is actuated into an open position by the fill plug;

wherein the fill plug is a user-removable fill plug that actuates the valve assembly when the fill plug is secured to the inlet; and wherein the user-removable fill plug is located at the top of the housing adjacent a handle, and wherein the valve assembly is located underneath and actuated in a downward direction by the user-removable fill plug.

* * * * *